United States Patent [19]

Hansen

[11] 3,990,344

[45] Nov. 9, 1976

[54] UNDERWATER EXPENDABLE EXPLOSIVE LINK

[75] Inventor: Charles E. Hansen, Chula Vista, Calif.

[73] Assignee: The United States of America as represented by the Secretary of the Navy, Washington, D.C.

[22] Filed: Jan. 13, 1975

[21] Appl. No.: 540,461

[52] U.S. Cl. ..... 89/1 B; 102/10

[51] Int. Cl.[2] ..... F42B 1/00

[58] Field of Search ..... 89/1 B, 1.5 F; 102/49.5, 10, 1, 90, 37.6; 60/35.6 RS

[56] References Cited

UNITED STATES PATENTS

| | | | |
|---|---|---|---|
| 2,379,447 | 7/1945 | Lindsey | 102/10 |
| 2,809,584 | 10/1957 | Smith | 102/49.5 |
| 2,937,595 | 5/1960 | Margulis et al. | 60/35.6 RS X |
| 3,089,417 | 5/1963 | Beyer et al. | 89/1 B X |
| 3,104,523 | 9/1963 | O'Donnell | 60/35.6 RS X |
| 3,384,016 | 5/1968 | Blanchard | 102/49.5 |
| 3,458,217 | 7/1969 | Pride et al. | 102/49.5 X |
| 3,688,988 | 9/1972 | Howison et al. | 102/49.5 X |
| 3,698,281 | 10/1972 | Brandt et al. | 89/1 B |
| 3,728,934 | 4/1973 | Palmer | 89/1 B |
| 3,757,988 | 9/1973 | Kunert | 89/1 B |
| 3,791,296 | 2/1974 | Vogt et al. | 102/10 |
| 3,919,939 | 11/1975 | Murray et al. | 89/1 B X |

*Primary Examiner*—David H. Brown

*Attorney, Agent, or Firm*—Richard S. Sciascia; Ervin F. Johnston; Thomas Glenn Keough

[57] ABSTRACT

An explosive disconnect joins two portions of an underwater cable and an electrical conductor extends from a squib to a remote detonator. The squib and conductor are cast inside a plug of epoxy or equivalent frangible material. Holes bored at opposite ends of the plug receive the two portions of the cable, for example, an anchor line and a buoy line. When the squib is detonated, the frangible plug disintegrates and an instrumentation package is buoyed to the surface for recovery. The nonmetallic explosive disconnect is waterproof, is corrosion resistent and is relatively inexpensive compared to other commercially available units.

1 Claim, 7 Drawing Figures

UNDERWATER EXPENDABLE EXPLOSIVE LINK

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Underwater release mechanisms are many and varied in design. One of the most widely used devices for releasing an underwater instrumentation package is the guillotine cutter device. This is usually costly, bulky and its reliability leaves something to be desired. Another type of underwater disconnect relies upon the corrosion of a certain portion which usually is a magnesium pin. Consequently, a predictable release time can not be precisely set since the seawater chemistry and temperature vary the corrosion time considerably. Pressure actuated release devices are used to a degree of success, yet, since a mechanical motion must be relied upon for release, corrosion and sediment can cause failure. Partially because of the reliability factor, explosive links are generally favored. One link utilizes the gas generated as an explosive charge is detonated. The gas forces a piston in a cylinder to either directly effect the release or to drive a cutter blade. While this type of link is reusable, this advantage is offset by the cost of reconditioning it and the reconditioning cost often approaches the cost of an expendable type of explosive release. One popular expendable release is a cylindrically shaped piece of machined metal having a cavity. A squib is placed in the cavity and it is filled with a casting material. Next, a midriff is machined exposing a thinner layer of metal which covers the squib. In addition to its high per unit cost, this release is plagued by two reliability faults. Seawater tends to work around the epoxy and the wet squib does not fire. The other fault is distressingly apparent when the squib detonates without fracturing the link. Since most of these links have at least a 5,000 pound tensile strength, chances are limited of recovering an instrumentation package by other means when the link fails to function. Thus, there exists in the state of the art a continuing need for an underwater disconnect that is reliable, inexpensive, and suitable for a variety of applications where reduced tensile loads need to be borne.

SUMMARY OF THE INVENTION

This invention is directed to providing an underwater explosive disconnect. An explosive squib is connected to a means for initiating the detonation of the squib and both are molded within a frangible casting material. This material has the property of disintegrating upon the detonation of the squib for effecting a reliable disconnect.

An object of the invention is to provide a reliable underwater disconnect.

Another object is to provide an inexpensive, explosive disconnect.

Yet another object is to provide an underwater disconnect that is ideally suitable for reduced tensile loads.

Still another object is to provide an underwater explosive disconnect which is relatively easily fabricated from available casting materials and explosive squibs.

Still another object is to provide an explosive member for ensuring the controlled scuttling of a buoyed object.

A further object is to provide a disconnect for reliably effecting the distribution of a water soluble dye.

Another object is to provide a reliable means for disconnecting panels from a submersible.

These and other objects of the invention will become more readily apparent from the ensuing description when taken with the drawings.

DESCRIPTION OF THE PREFERRED EMBODIMENTS

Figure 1:
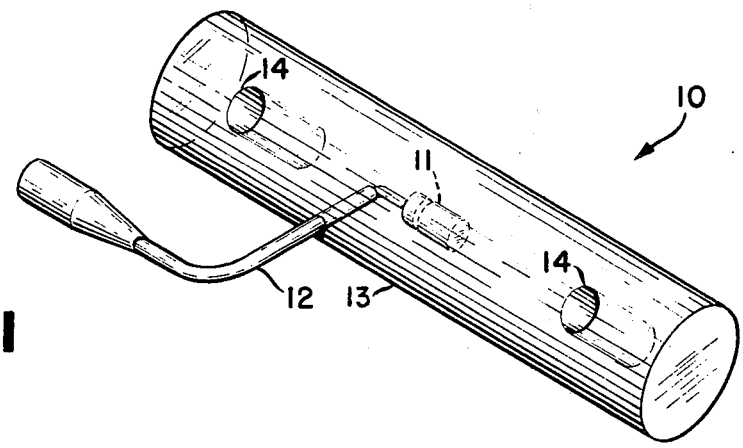
FIG. 1 is an isometric depiction of one embodiment of the invention.

Referring now to the drawings, FIG. 1 shows anunderwater explosive disconnect 10 in its least complicated form. An explosive squib 11 is coupled to an underwater electrical connector or conductor 12 of electromagnetic energy which extends off to a remotely located initiation device. To this point the components of the invention are well known and the precise manner of detonating a squib by such a connector is widely practiced. However, by the inclusion of the cylindrically shaped body member 13 lower per unit cost and higher reliability are attained by the functionally cooperating elements.

At first glance the fabrication of the underwater explosive disconnect appears to follow a rather straightforward series of events. It must be emphasized that it is at the highly reliable, inexpensive end product that the essence of this invention resides. First, squib 11 is coupled to connector 12. Next, the squib and connector are placed inside a tubularly shaped mold sleeve, preferably by inserting them through a hole provided in the mold sleeve's side. The lower end of the mold and the hole in its side are then closed-off usually by the application of a putty-like sealant material. This prevents the epoxy from running out of the mold prior to its hardening. During the molding operation, care must be taken not to add too much catalyst since the heat generated as the epoxy hardens could accidentally initiate detonation of the squib.

After the mold has been filled with the epoxy and care is taken to maintain the squib centered in the mold, the epoxy begins to cure and the body member solidifies. Now, optionally, the mold is cut away or can be left on the body member, the latter only if the mold is not too strong so as to contain the exploding squib upon detonation. Removal of the mold is facilitated when its interior has been coated with a suitable releasing agent prior to pouring the epoxy. All that remains to be done is to drill a pair of holes 14 at opposite ends of the body member. These holes provide for connection for lines extending from instrumentation packages, buoys, anchors, or other underwater devices.

An underwater explosive disconnect fabricated as described is ideally suitable for separating underwater objects where not unduly heavy tensile loads need be borne across the disconnect. By merely making the cylindrically shaped body member larger or smaller i.e. of greater or lesser diameter, the load bearing capability of the disconnect length is changeable. A modestly, powered squib is capable of easily shattering the epoxy body member to reliably assure a disconnect. An advantage of having this type squib with its relatively low explosive force avoids the possibility that any instrumentation packages would be damaged by the concussion wave.

Figure 2:
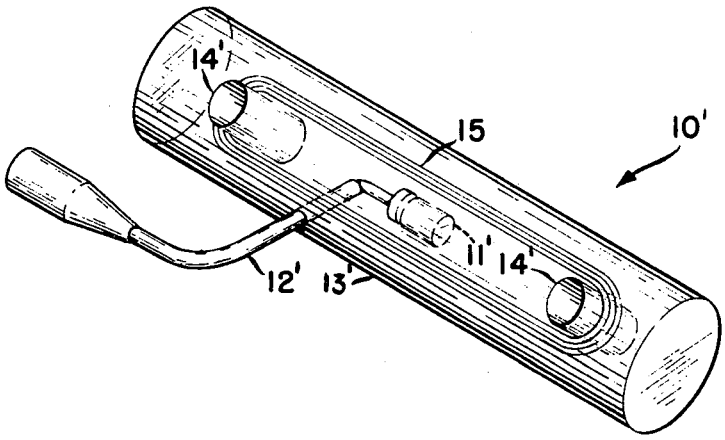
FIG. 2 is an isometric view of a modification of the invention.

An explosive underwater disconnect having a greater tensile load bearing capability is shown in the embodiment 10' of FIG. 2. This disconnect has a number of glass fibers 15 running the length of the body member and encircling holes 14'. The body member 13' has a conductor 13' extending from a squib 11'. When these fibers are added, the explosive power of the squib must be appropriately escalated. The squib must have sufficient power to shatter the body member and separate the fibers.

Figure 3:
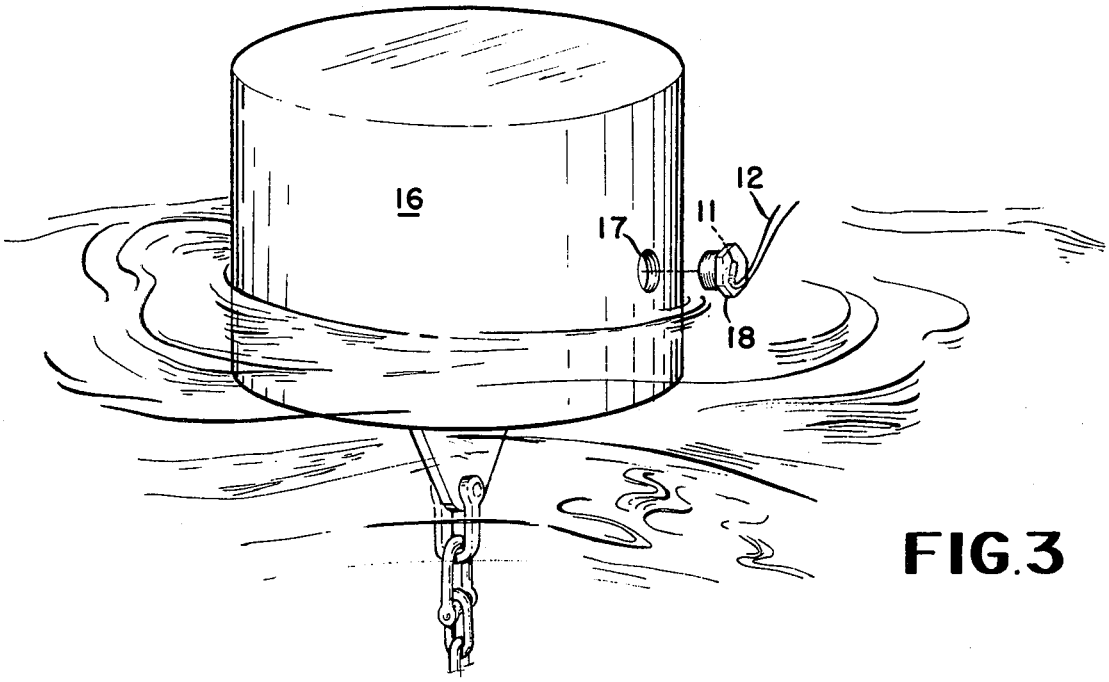
FIG. 3 shows yet another application of the inventive concept.

A further modification of the disclosed inventive concept appears in FIG. 3. In this embodiment, a float or buoy 16 is provided with a threaded hole 17 at or slightly below the water line for receiving an appropriately threaded plug 18. The plug has a squib 11 and an electrical connector 12 extending from it to a remote detonator. Threaded plug 18 is formed by filling a mold full of epoxy after the squib and connector have been placed within the mold. Detonation of the squib disintegrates the plug and the float sinks.

Figure 4:
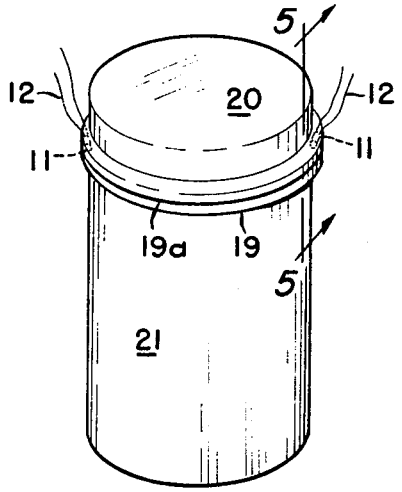
FIG. 4 is yet another modification of the present invention.
Figure 5:
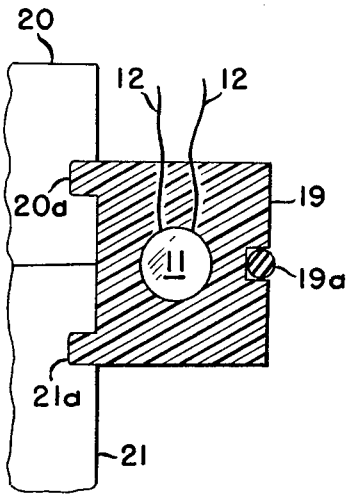
FIG. 5 is a cross sectional view of the modification generally taken along lines 5—5 in FIG. 4.
Figure 6:
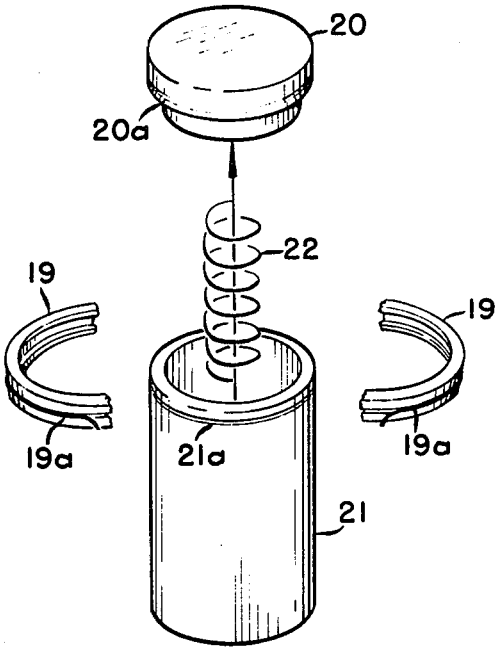
FIG. 6 depicts the rupture of the annular collar and the release of a marker dye into the water.

Another modification of the underwater explosive disconnect is depicted in FIGS. 4, 5, and 6. In this embodiment an annular collar 19 has its O-ring **19*a* holding a cap member 20 on a can member 21. These two members functionally cooperate and form a container for an underwater dye marker. The annular collar has a U-shaped cross-sectional configuration and is split in at least one place about its circumference. This allows it to be spread and fitted into ring shaped grooves 20*a* and 21*a*. A pair of squibs 11 are cast at the opposite diametric extremes of the annular collar and electrical connectors reach to a remotely located initiation device. Noting FIG. 6, upon detonation of the squibs, the sections of the epoxy annular collar containing the squibs disintegrate and the collar is blow from the cap and can members. An internally carried spring 22** forces the cap member from the can member and a dye, not shown, escapes into the water.

Figure 7:
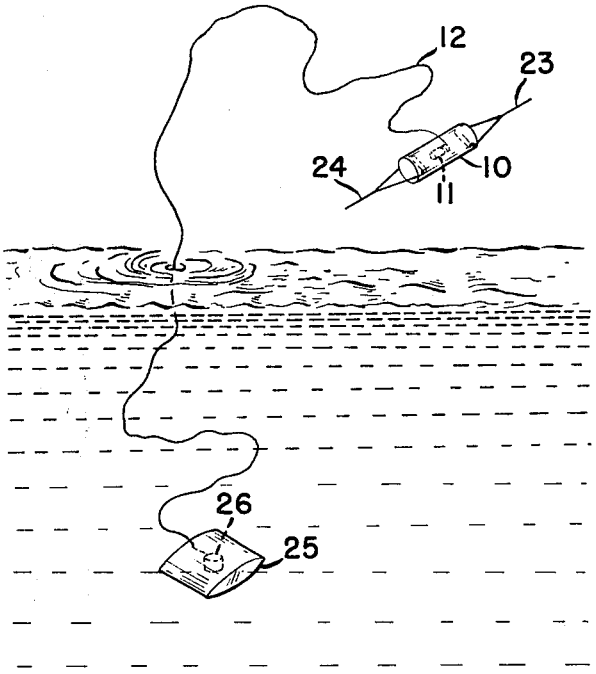
FIG. 7 shows a scheme for delayed detonation of a disconnect.

A delayed actuation of the underwater explosive disconnect is depicted in FIG. 7. A pair of lines 23 and 24 joining, for example, a buoy and an anchor, are coupled to underwater explosive disconnect 10. An electrical connector 12 joined to the squib reaches to a polyvinyl alcohol bag 25 which contains a deactivated seawater battery 26. One of the properties of the polyvinyl alcohol bag is that it dissolves in water after a predetermined time. Hence, this modification of the invention after a predetermined time, governed for example, by the thickness of the bag, dissolves, partially at least, and seawater reaches the battery. Consequently, a current is produced to initiate detonation of the squib.

What has been disclosed and claimed is an inexpensive, underwater explosive disconnect. The simplicity of design assures a high reliability. Since the squib and connector are molded entirely within the several shapes of body members, there is a markedly reduced possibility of water reaching the squib.

Obviously, many modifications and variations of the present invention are possible in the light of the above teachings, and it is therefore understood that within the scope of the disclosed inventive concept, the invention may be practiced otherwise than specifically described.

What is claimed is:

1. In an underwater explosive disconnect for holding a spring biased cap on a dye can an improvement therefor is provided comprising:

a pair of squibs;

a conductor of electromagnetic energy connected to said pair of squibs for initiating the detonation thereof; and an epoxy casting formed in two sections shaped as an annular collar having a generally U-shaped cross-sectional configuration for retaining the spring biased cap on the dye can for frangibly containing said pair of squibs at opposite diametric extremes of said annular collar and being molded thereabout, upon said detonation, the annular collar shatters effecting the release of the cap.

* * * * *